US007204390B2

(12) United States Patent
Widlund

(10) Patent No.: US 7,204,390 B2
(45) Date of Patent: Apr. 17, 2007

(54) STACK OF INTERFOLDED MATERIAL SHEETS AND METHOD FOR ITS PRODUCTION

(75) Inventor: Urban Widlund, Pixbo (SE)

(73) Assignee: SCA Hygiene Products AB, Gothenburg (SE)

( * ) Notice: Subject to any disclaimer, the term of this patent is extended or adjusted under 35 U.S.C. 154(b) by 197 days.

(21) Appl. No.: 10/822,844

(22) Filed: Apr. 13, 2004

(65) Prior Publication Data

US 2004/0222582 A1 Nov. 11, 2004

Related U.S. Application Data

(60) Provisional application No. 60/467,599, filed on May 5, 2003.

(51) Int. Cl.
*A47K 10/24* (2006.01)
*B65H 1/00* (2006.01)
*B32B 3/04* (2006.01)

(52) U.S. Cl. ..... 221/47; 221/48; 428/124; 428/126

(58) Field of Classification Search ..... 361/234; 221/47–48; 428/124, 126
See application file for complete search history.

(56) References Cited

U.S. PATENT DOCUMENTS 4,638,921 A 1/1987 Sigl et al.
5,328,053 A 7/1994 Cook et al.
5,356,032 A 10/1994 Rhodes
5,540,354 A * 7/1996 Annand ..... 221/52
5,678,728 A * 10/1997 Leto ..... 221/185
6,012,572 A * 1/2000 Heathcock et al. ..... 206/233
6,126,009 A 10/2000 Shiffler et al.
6,602,575 B2 * 8/2003 Lefevre Du Grosriez et al. ..... 428/124
2003/0213810 A1 * 11/2003 Wu ..... 221/34

FOREIGN PATENT DOCUMENTS

| | | |
|---|---|---|
| EP | 0 286 538 | 10/1988 |
| EP | 0 970 909 | 1/2000 |
| EP | 0 980 841 | 2/2000 |
| EP | 1 044 894 | 10/2000 |
| EP | 1 090 868 | 4/2001 |
| EP | 1 118 568 | 7/2001 |
| EP | 1 127 830 | 8/2001 |
| WO | WO 97/39964 | 10/1997 |

* cited by examiner

*Primary Examiner*—Brian Sircus
*Assistant Examiner*—Dharti H. Patel
(74) *Attorney, Agent, or Firm*—Young & Thompson

(57) ABSTRACT

A stack of material sheets, which material sheets have a longitudinal direction and a transverse direction and which material sheets are folded at least once in the transverse direction along a transverse folding line and at least once in the longitudinal direction along a longitudinal folding line. The material sheets are interlinked such that, when a first material sheet is extracted, a predetermined part of the next material sheet is fed out. Two consecutive material sheets in the stack are folded into one another and are in this way interlinked by panels of the respective material sheets. The said panels constitute rectangles each having two delimiting edges namely a longitudinal fold edge and a transverse fold edge. The two consecutive material sheets lie stacked with the longitudinal fold edge of a first material sheet arranged in the opposite direction in relation to the corresponding longitudinal fold edge of the next, second material sheet. In addition, a panel of the first material sheet is enclosed by two panels of the next material sheet.

22 Claims, 7 Drawing Sheets

A
508
504A
507d
507c
507a
507b
A
B
504B
509
508
503A
503B
509
502

507
503A
505A 507
503B,505B

STACK OF INTERFOLDED MATERIAL SHEETS AND METHOD FOR ITS PRODUCTION

CROSS REFERENCE TO RELATED APPLICATION

This application claims the 35 U.S.C. § 119 (e) benefit of Provisional U.S. Application 60/467,599 filed on May 5, 2003.

FIELD OF THE INVENTION

The invention relates to a stack of material sheets, which material sheets have a longitudinal direction and a transverse direction and which material sheets are folded at least once in the transverse direction along a transverse folding line, the material sheets being interlinked in such a way that, when a first material sheet is extracted, a predetermined part of the next material sheet is fed out, and a method for production of such a stack of material sheets.

BACKGROUND OF THE INVENTION

Stacks of interlinked material sheets, such as tissue sheets, or material sheets made of non-woven or equivalent flexible wiping materials, are usually folded so that they occupy as limited an area as possible at the same time as they provide sheets with maximum unfolded area. For the user, it is often desirable that material sheets for, for example, wiping purposes occupy as small an area as possible in stack form, as stacks of material sheets are often placed on tables or other surfaces with limited space.

Within the technical field, sheets which have been folded individually once or a number of times and thus provided with a corresponding V, Z or W appearance are well known. The material sheets have subsequently been folded into one another with one or more parts in order to form a continuous stack of sheets. An advantage of this type of interfolding is that, when the stack of sheets is packed in a dispenser, the removal of a sheet from the stack of sheets brings about automatic feeding-out of the next sheet through a dispensing opening present in the dispenser. The sheet extracted then also acquires its full area which is then available for immediate use.

When the sheets are folded in only one direction, however, the problem remains that the stack of sheets retains its full extent in the non-folded direction. The reduction in area which it is desired to achieve in connection with the folded material sheets is then achieved in only one direction, which results in a stack of material sheets which takes up a relatively large area. Limiting the sheets in the non-folded direction in order to reduce the surface area of the stack results in sheets which have a small width in relation to the length after extraction as well. The user often feels that this type of material sheet is entirely inadequate as wiping, especially of large areas, can be performed best if the sheets are both long and wide.

Another problem with this type of folding of material sheets arises furthermore when a certain number of material sheets have already been removed from the dispenser in which they are packed. A prerequisite for the holding-together capacity between two conventionally folded material sheets is that the interlinking angle which is brought about in the folding of a material sheet is sufficiently acute. The purpose of the acute angle is then to grip around the next material sheet and thus establish secure interlinking between the material sheets. When a top material sheet is removed through a dispensing opening, the distance to the next material sheet increases relatively promptly. As a consequence of the interlinking angle increasing, the risk of the material sheets sliding out of the interlinking grip increases. In such a situation, the next material sheet may then drop down from the opening of the pack towards the interior of the pack, where it is difficult for the user to reach it.

In a conventionally arranged stack of material sheets, moreover, it is difficult for the material sheets arranged last to reach up to a conventionally designed dispensing opening in a dispenser as the material sheets often have an extent which means that the length with which the last material sheets can extend out through a dispensing opening is limited.

Attempts to counteract the abovementioned problems with stacks of interlinked material sheets packed in a dispenser have resulted in shallower packs, which has in turn led to problems of insufficient material sheet storage capacity. In addition, a risk remains that, in spite of the pack height being limited, the next sheet may still slide out of the interlinking folding grip.

There is consequently a great need to improve the folding with which a stack of material sheets is interlinked, so that the dispensing of material sheets from a stack of sheets is guaranteed at the same time as the user is provided with a material sheet of very good size. In addition, there is a need for a method in which the material sheets are interfolded in a simple and appropriate manner to form a stack of sheets of the kind mentioned above.

SUMMARY OF THE INVENTION

With the present invention, a stack of material sheets of the kind referred to in the introduction has been produced, which stack of material sheets essentially eliminates the problems associated with previously known such stacks, and in this connection the interlinking capacity between two material sheets arranged in a stack has been improved, and a stack of material sheets both with a limited surface area and comprising material sheets which are both long and wide in the unfolded state has also been made possible.

In this connection, a stack of material sheets arranged according to the invention is characterized mainly in that the material sheet forming part of the stack is also folded at least once in the longitudinal direction along a longitudinal folding line, and in that two consecutive material sheets in the stack are folded into one another and are in this way interlinked by panels of the respective material sheets, which panels constitute rectangles each having two delimiting edges in the form of a longitudinal fold edge and a transverse fold edge, and where the two consecutive material sheets lie stacked with the longitudinal fold edge of a first material sheet arranged in the opposite direction in relation to the corresponding longitudinal fold edge of the next, second material sheet, and also with a panel of a first material sheet enclosed by two panels of the next material sheet. In this connection, the term "enclosed" means that the three panels of the first and the next material sheet will lie alternately with one panel from the next material sheet lying on one side and another panel on the other side of the panel of the first material sheet. The panel of the first material sheet will thus be in direct contact with the two panels of the next material sheet located on either side. The stack of material sheets is folded in such a way that the individual material sheets are folded around one another in a simple manner at the same time as the interlinking between two consecutive material sheets is strengthened. As the folding of the material sheets is performed both in the longitudinal direction and in the transverse direction, a "pocket" is thus produced, into which the next material sheet is inserted. The folding is also performed in such a way that each sheet of two consecutive material sheets is folded by turns so that two opposite fold edges are formed. Arranging the material sheets as described above brings about a stronger folding grip which, when the stack is stretched, holds two consecutive material sheets together better compared with previous conventional foldings of interlinking material sheets which are interfolded in only one direction.

As mentioned above, the interlinking of the respective material sheets is effected by means of a panel which constitutes a rectangle delimited by a longitudinal folding line and a transverse folding line. Here, the term rectangle means a four-sided geometrical shape where each side is connected to the adjacent side at right angles. A square is to be regarded as a subset of the rectangular shape, in which the square has four sides of the same length. Here, longitudinal means that extent of the material sheet which lies in line with the extent of a material web which consists of material sheets arranged in line one after another before the initial folding step. Here, transverse means the extent which lies at right angles to the longitudinal extent. The term folding line refers to the line which forms a delimitation between two parts of a material sheet when these are folded towards one another. The two surface areas which are formed on either side of the folding line are called panels. When the material sheet is folded around both a longitudinal and a transverse folding line, the expression panel means the part area which is delimited by both a longitudinal and a transverse folding line.

According to one embodiment of the invention, the interlinking panel constitutes a quarter of the total area of the unfolded sheet. In this embodiment, the first material sheet lies directly adjacent to the third material sheet, as the second material sheet does to the fourth, provided all the material sheets are of the same size. This arrangement means a direct succession of material sheets, which arrangement stabilizes the holding-together of the consecutive material sheets.

In another embodiment, the interlinking panel constitutes an eighth of the total area of the unfolded sheet. This embodiment means that there is a spacing between the first material sheet and the third material sheet, that is to say the interlinking panel of the first material sheet does not lie directly adjacent to the following panel in the third material sheet as in the embodiment above. This embodiment affords a possibility for letting large cloths overlap without the common area becoming so large that the interlinking cloths are difficult to pull apart. In addition, advantages such as the user having access to a larger surface area of unfolded wiping material without the interfolded stack of material sheets increasing in size are obtained. It is also possible to use material sheets with an even longer longitudinal extent. The material sheet is then provided with further transverse folding lines intended to be folded around in order to reduce the surface area of the stack according to the principle mentioned above.

The two embodiments described above can of course be combined so that the stack of material sheets consists of material sheets of different size and with different mutual spacing.

In a stack of material sheets according to the present invention, the interlinking panel is preferably a square. The square shape means that the longitudinal folding line and the transverse folding line have an extent of the same size, the holding-together forces then being balanced evenly in the folded structure.

The material sheet can also advantageously be made up of non-square shapes, that is to say the material sheet per se can consist of two longer sides and two shorter sides. Folding the material sheet in both the longitudinal direction and the transverse direction therefore divides the material sheet into a number of part areas of the same size which correspondingly have two long sides and two shorter sides.

In the material sheet, at least one longitudinal folding line can be somewhat displaced in relation to the longitudinal centre line in at least one of the two consecutive material sheets. Here, the longitudinal centre line means the line which delimits two areas of the same size of a material sheet in the longitudinal direction as viewed when the material sheet is advanced in a material web. Implicitly, this embodiment means that, in addition to a folding line coinciding with the centre line, further longitudinal folding lines can be located on one or both side(s) of a central longitudinal folding line, after which further longitudinal parts will lie folded in against the rest of the material sheet. Such an embodiment leads to an increased total surface area of the fully unfolded material sheet. Alternatively, a smaller longitudinal surface area can be folded in around a further folding line in such a way that this area will lie on top of the material sheet lying on top of the stack. The user is then provided with a gripping flap lying on top of the uppermost panel when the stack of material sheets is in its ready-folded state. Arranging such a gripping flap is advantageous as the user can quickly take hold of the uppermost material sheet and thus have access to the wiping material. When the material sheets are advanced in the continuous material web, for the purpose of being folded around one another in order to bring about the interlinking mentioned above, the further longitudinal folding lines are already formed, which means that the further longitudinal parts lie folded in against the rest of the material sheet.

The embodiment also comprises a longitudinal folding line which is displaced in relation to the longitudinal centre line. The interlinking rectangles then have a non-square shape, and the panels formed by the material sheet have different surface areas. A stack of material sheets constructed with the rectangles is advantageous as a displacement of the folding line means a displacement of the panels in the folded material sheet, the panels which would otherwise lie completely one on top of another then having different size. As the two panels do not then lie arranged edge to edge with regard to the longitudinal side edges of the material sheet, taking hold of the first material sheet in the ready-folded stack is facilitated. The gripping flap thus formed is advantageous as the user quickly has access to the wiping material. In addition, at least one transverse folding line can also be somewhat displaced in relation to a corresponding transverse centre line in at least one of the two consecutive material sheets.

As the construction of the stack of material sheets is such that the user can take the individual material sheets out of the dispenser simply, the stack can be used in all situations where the user requires material sheets quickly, without having to be concerned about the risk of the majority of the stack following when feeding-out takes place. A particularly suitable area of use is the wiping of various surfaces. In this connection, the material sheet is suitably made from tissue paper, non-woven or equivalent flexible wiping material.

A tissue paper is defined as a soft absorbent paper with a grammage of less than 65 g/m$^2$ and usually between 10 and 50 g/m$^2$. Its density is usually less than 0.60 g/cm$^3$, preferably less than 0.30 g/cm$^3$, and most preferably between 0.08 and 0.20 g/cm$^3$. The present invention relates to all types of tissue paper. For example, the tissue paper may be provided in both dry and moist states and be either creped or uncreped.

The fibres in the tissue paper are mainly pulp fibres from chemical pulp, mechanical pulp, thermomechanical pulp, chemimechanical pulp and/or chemithermomechanical pulp (CTMP). The fibres can also be waste-paper fibres. The tissue paper can also contain other types of fibre which, for example, increase strength, absorption or paper softness. These fibres can be manufactured from regenerated cellulose or synthetic materials such as polyolefins, polyesters, polyamides etc.

The tissue paper which comes out from the tissue machine may be in the form of a paper sheet with a single ply. The tissue paper may also be in the form of a laminated tissue product with a number of plies, which product comprises at least two tissue plies which are usually joined either by adhesive or mechanically. The adhesive can be applied over the whole of the paper or only in certain areas, for example dots or lines, or only along the edges of the product. The mechanical methods comprise mainly embossing either over the whole surface of the plies or only along the edges, what is known as edge embossing. In the finished product, the plies are usually easily identifiable and can often be separated from one another as individual plies.

The tissue paper can comprise one or more layer(s). If the tissue paper has a number of layers, the layers can be separated from one another only with considerable difficulty, and they are then joined mainly by means of hydrogen bonds. The various layers may be identical or have different characteristics with regard to, for example, fibre composition and chemical composition.

The term non-woven is applied to a large number of products with characteristics which may be said to lie between on the one hand the category of paper and cardboard and on the other hand textiles. Non-wovens represent flexible, porous structures which are not manufactured by means of the classic weaving and knitting methods but by intertwining and/or cohesive and/or adhesive bonding of typical synthetic textile fibres which, for example, may be present in the form of continuous fibres or fibres which are prefabricated with an infinite length such as synthetic fibres which are manufactured in situ or in the form of staple fibres. Alternatively, they can be manufactured from natural fibres or from mixtures of synthetic fibres and natural fibres.

The material sheets making up the stack can of course be of any size but, as they are intended primarily for use in connection with wiping, the material sheet preferably has a surface area in the unfolded state which can easily be controlled by the hand of a user. It is often important for the user to have wiping material in close proximity to, or on, the surfaces which may be expected to require cleaning. As the surfaces may be cluttered with other objects or have a limited setting-down surface, there is a requirement for material sheets which occupy a small area in the interfolded state. For this reason, the stack should not exceed certain dimensions with regard to both longitudinal direction and transverse direction either. The material sheet then suitably has a surface area in the unfolded state of between 100 cm$^2$ and 1500 cm$^2$, preferably between 256 cm$^2$ and 576 cm$^2$, and corresponding surface areas in the interfolded state are then suitably between 25 cm$^2$ and 375 cm$^2$, preferably between 64 cm$^2$ and 144 cm$^2$.

In one embodiment of the invention, the material sheet has two further transverse folding lines. The material sheet then has an increased extent in the longitudinal direction without the dimensions of the stack after interfolding increasing. The material sheet then suitably has a surface area in the unfolded state of between 200 cm$^2$ and 2500 cm$^2$, preferably between 512 cm$^2$ and 1152 cm$^2$, and corresponding surface areas in the interfolded state are as above between 25 cm$^2$ and 375 cm$^2$, preferably between 64 cm$^2$ and 144 cm$^2$.

Although the stack of material sheets as above has a structure which is stabilized in itself, the stack of material sheets is advantageously arranged in a dispenser. The dispensing opening of the dispenser can be designed in any desired way and therefore have the shape of a slot, a rectangle, an oval, an asymmetric shape or the like.

However, the stack of material sheets is advantageously arranged in a dispenser which is provided with a dispensing opening arranged diagonally across the stack of material sheets. In this embodiment, the uppermost material sheet is arranged so that it protrudes through the dispensing opening with a triangular part area of the rectangular panel. The relationship between such a dispensing opening and a stack of material sheets according to the invention is such that, when a material sheet is extracted through the dispensing opening, the material sheet is unfolded completely so as thus to acquire its full surface area. The user is consequently provided with a material sheet of very good size, both in the longitudinal direction and in the transverse direction. The stack is therefore especially useful in cases where it is necessary for the user to be provided quickly with fully unfolded material sheets which are immediately ready for use. The user who requires material sheets rapidly for, for example, wiping is thus spared problems associated with separate steps for manually unfolding prefolded parts of the material sheet.

The stack of material sheets can be arranged in a dispenser designed conventionally as a box. A diagonally arranged dispensing opening then preferably extends from one corner of the box to a diagonally opposite corner. The diagonal can nevertheless also be displaced slightly in relation to one or both of the corners.

Alternatively, a dispensing opening arranged diagonally across the stack of sheets as above can be provided by means of a dispenser consisting of two obstacles lying on the stack which are joined by two diagonally oppositely positioned side arrangements and also a bottom plate. The two obstacles consist of, for example, two bars integrated at their respective ends combined either firmly or freely with the side arrangements which can also consist of bars. The two oppositely positioned side arrangements are preferably attached to the bottom plate. In order to provide the necessary resistance when material sheets are extracted from the stack of material sheets, the dispenser as above preferably consists of a relatively heavy material, for example a metal with high density such as iron.

The dispenser consisting of obstacles, side arrangements and bottom plate can of course also consist of cardboard, plastic or the like. In this case, however, it may be suitable for the bottom plate to be coated with some form of attachment means which can retain the dispenser against a surface such as a table, a wall or the like. When the dispenser is fastened to the surface, the force, which acts on the dispenser when extraction of the material sheets takes place, is thus counteracted.

The invention also relates to a method for production of a stack of material sheets. In accordance with the invention, a first web of adjacent individual material sheets is applied to a second web of adjacent individual material sheets. With this application, a longitudinal part of the first web will overlap a longitudinal part of the second web, and the first material sheet in the first web will overlap the first material sheet in the second web with a panel of the material sheet. The panel constitutes a rectangle delimited by a longitudinal folding line and a transverse folding line. In the subsequent folding step, the underlying web of the abovementioned webs is folded on a longitudinal folding line so that the material sheets of this web will enclose a part of the material sheets of the other web. The other web is then folded on a longitudinal folding line so that the material sheets of this web will enclose a part of the material sheets of the first-mentioned web. The structure folded in the longitudinal direction is then folded together in the transverse direction on at least one transverse folding line, in each individual material sheet, so that a stack of material sheets is formed.

In the manufacturing process described above, it is described how individual material sheets are arranged and folded so that a stack of material sheets is arranged according to the invention in a way which is simple and efficient in terms of production.

In order to produce a stack of material sheets according to another embodiment, the material sheets in the respective first and second web are separated from one another by a mutual spacing. When the webs are combined with one another, the material sheets are in this way provided with a mutual spacing with the first material sheet in the first web overlapping the first material sheet in the second web with a panel of the respective material sheets. The panel constitutes a rectangle delimited by a transverse folding line and a longitudinal folding line.

In the production of a stack of material sheets as above, the material sheets in the respective webs are arranged at a predetermined mutual spacing, for example corresponding to half the length of the material sheet. A spacing between the material sheets can be brought about by virtue of the material sheets initially having a predetermined spacing when added to the continuous web. Alternatively, the material sheets can be added to the continuous web directly following one another and then be separated from one another in a separate step. Advantageously, use is made of the slip and cut method, which is well known within the technical field.

In the production of a stack of material sheets, displacements of the material webs can also be brought about in the transverse direction. The longitudinal folding line in the material sheets of at least one web can then be arranged so that, for example, it runs beyond the centre line in the web. In a preferred embodiment, however, the longitudinal folding line runs along the centre line which is essentially located at a distance corresponding to half the width of the material sheet.

BRIEF DESCRIPTION OF THE DRAWINGS

The invention will be described in greater detail below with reference to the figures which are shown in the accompanying drawings, in which.

These drawings are schematic and do not limit the scope of the invention.

DESCRIPTION OF THE PREFERRED EMBODIMENTS

Figure 1:
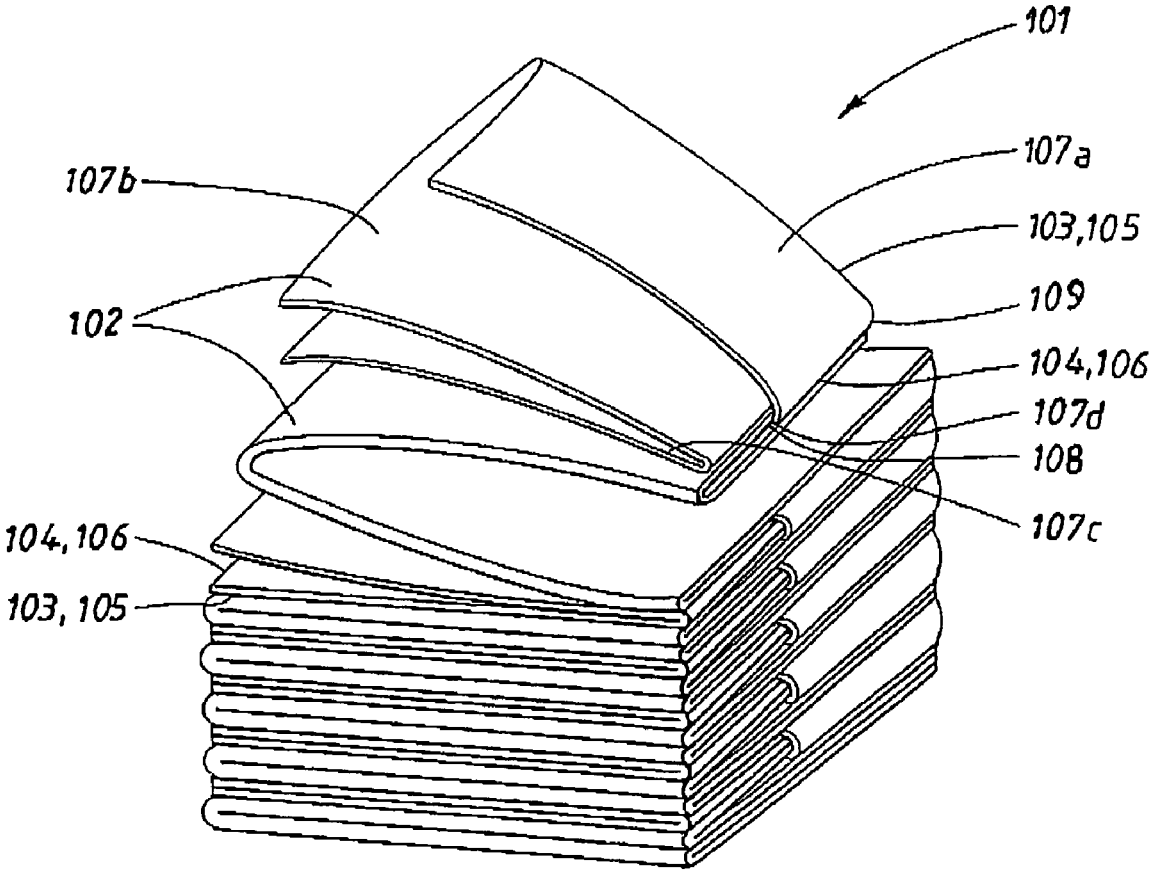
FIG. 1 shows a perspective view of a stack of material sheets according to one embodiment of the invention.

FIG. 1 shows a stack 101 of material sheets 102 according to one embodiment of the invention. Each individual material sheet 102 is folded on the one hand around a longitudinal folding line 103 and on the other hand around a transverse folding line 104, so that a longitudinal fold edge 105 and a transverse fold edge 106 are formed. Here, the longitudinal folding line 103, and thus the longitudinal fold edge 105, is displaced with regard to the longitudinal centre line of the material sheet 102. The folded material sheet therefore has four rectangles or panels 107*a, b, c, d* of different size, but panels 107*a, d* are essentially the same size and panels 107*b, c* are essentially the same size. As the first panel 107*a* does not overlap the whole surface area of the second panel 107*b*, the user can take hold of only the first panel 107*a* more easily. The uppermost material sheet will then, when the accompanying extraction from the stack of sheets 101 takes place, be unfolded completely, as a result of which the user is provided with a fully unfolded wiping material. The two first panels 107*a, b* of the material sheet lying on top of the stack are delimited by the transverse folding line 104 from the two second panels 107*c, d*. The uppermost material sheet encloses with its transverse fold edge 106 a part of a transverse side edge 108 of the next material sheet in the stack. At the same time, the two second panels 107*c, d* enclose with a longitudinal fold edge 105 a part of a longitudinal side edge 109 of the next material sheet in the stack. The next material sheet is therefore interlinked with the uppermost material sheet by virtue of the first panel of the next material sheet being enclosed by both a longitudinal fold edge 105 and a transverse fold edge 106 of the uppermost material sheet, or in other words the panel 107*d* of the first material sheet is enclosed by two panels of the next material sheet. The two consecutive material sheets therefore lie stacked with a longitudinal fold edge 105 of the uppermost material sheet arranged in the opposite direction in relation to the corresponding longitudinal fold edge of the next material sheet. The following material sheets are interlinking with one another in a corresponding way.

Figure 2:
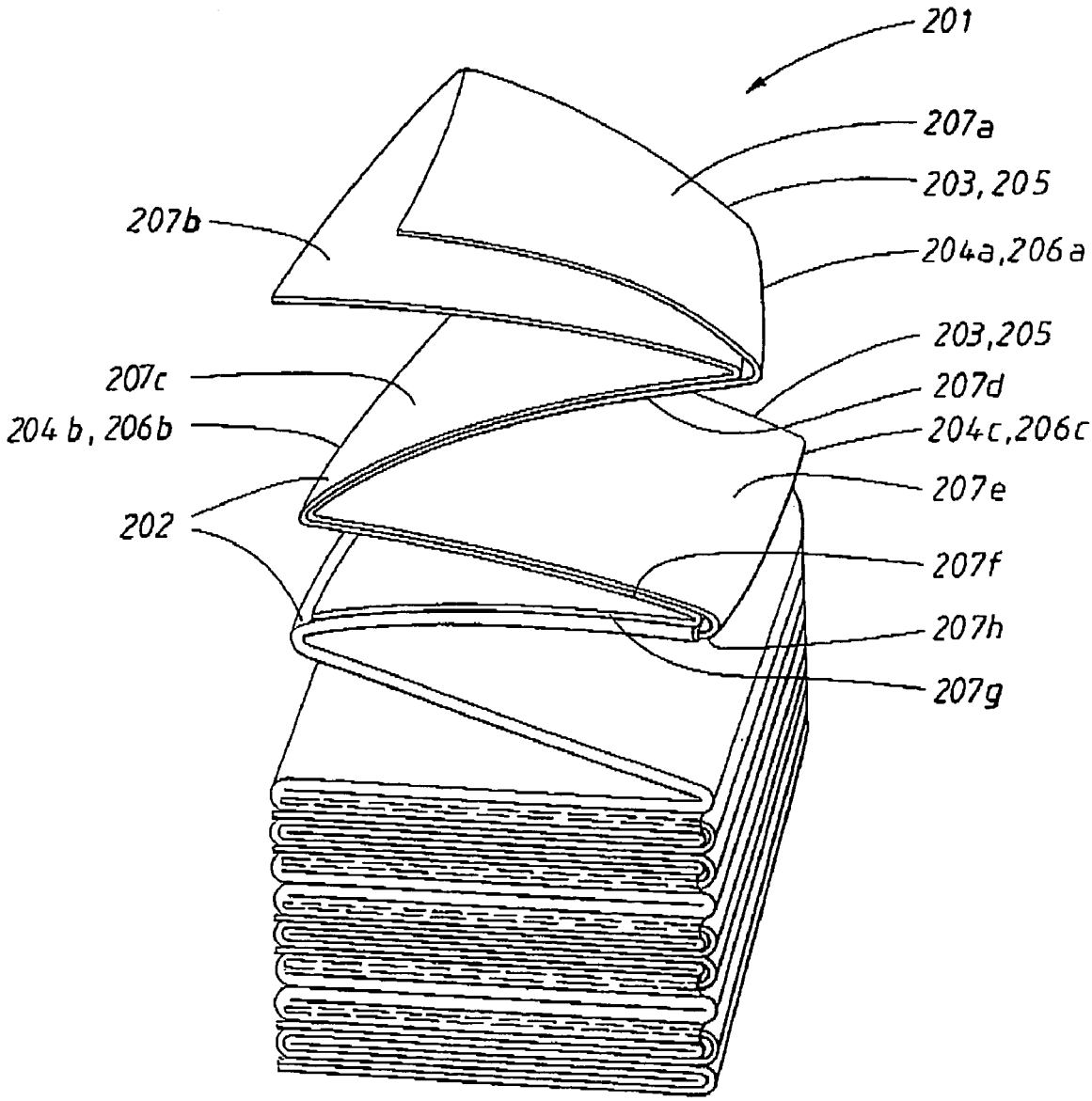
FIG. 2 shows a perspective view of a stack of material sheets according to another embodiment of the invention.

FIG. 2 shows a stack 201 of material sheets 202 according to another embodiment of the invention. Each individual material sheet 202 is folded on the one hand around a longitudinal folding line 203 and on the other hand around three transverse folding lines 204*a, b, c*, so that a longitudinal fold edge 205 and three transverse fold edges 206*a, b, c* are formed. In contrast to the four panels of the previous embodiment, the material sheet folded according to this embodiment has eight panels 207*a, b, c, d, e, f, g, h,* which panels are of essentially the same size. The uppermost material sheet is interlinked with the next material sheet as described above. In this embodiment, the four central panels 207*c, d, e, f* in the material sheet have no interlinking function but are intended only to provide material sheets with an enlarged surface area of a completely unfolded material sheet without the surface area of the stack increasing at the same time.

Figure 3:
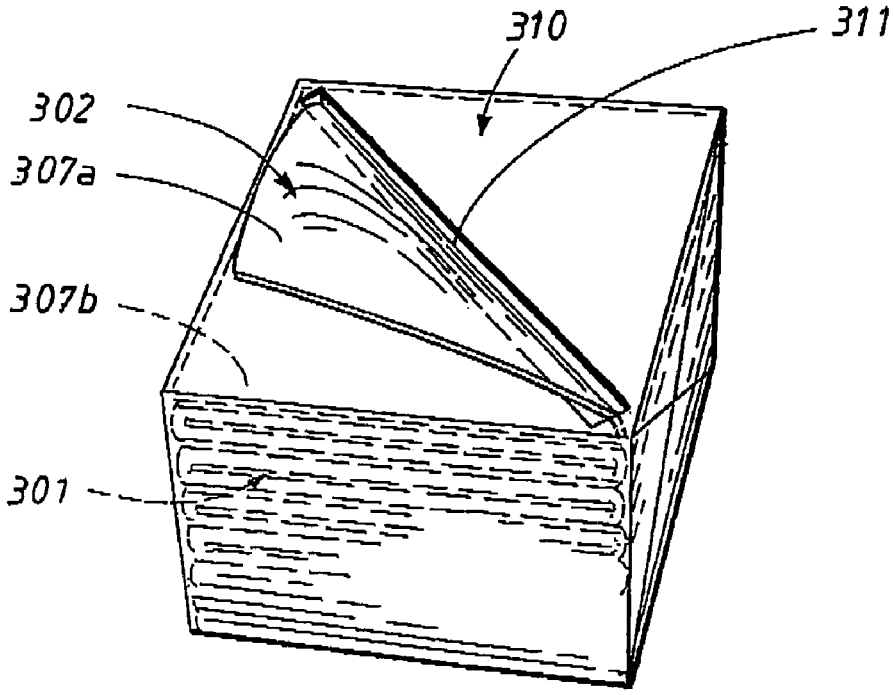
FIG. 3 shows a dispenser containing a stack of material sheets according to the invention.

FIG. 3 shows a dispenser 310 in the form of a box, in which a stack 301 of material sheets 302 according to the invention has been arranged. The dispenser 310 is provided with a dispensing opening 311 in the form of a slot which is arranged diagonally across the stack of material sheets. The dispensing opening 311 thus extends from a corner on one side of the dispenser 310 to a diagonally opposite corner on the same side. The first panel 307*a* of the uppermost material sheet is therefore presented for the user with a triangular part area, which offers a good and easily accessible gripping surface. The next panel 307*b* is located immediately inside the dispenser 310. The diagonally arranged dispensing opening 311 is related to the stack of material sheets in such a way that, when the material sheet is extracted through the dispensing opening 311, the material sheet 302 is unfolded to its full surface area. The user is thus provided with a fully unfolded material sheet 302 which is ready for use. The extraction of the uppermost material sheet also causes the next material sheet to be fed out automatically through the dispensing opening 311 with a corresponding triangular part area of its first panel. This procedure provides assurance for the user that it will be possible for all material sheets to be removed easily from the dispenser.

Dispensing through the dispensing opening 311 can be facilitated by virtue of the dispensing opening 311 being provided with means for simpler dispensing, such as, for example, plastic film in the form of "fingers" as described in, for example, EP 1 201 564, which fingers are arranged adjacent to the dispensing opening or the like. Alternatively, other shapes of dispensing opening 311 can be used, which shapes serve for smoother feeding-out.

Figure 4:
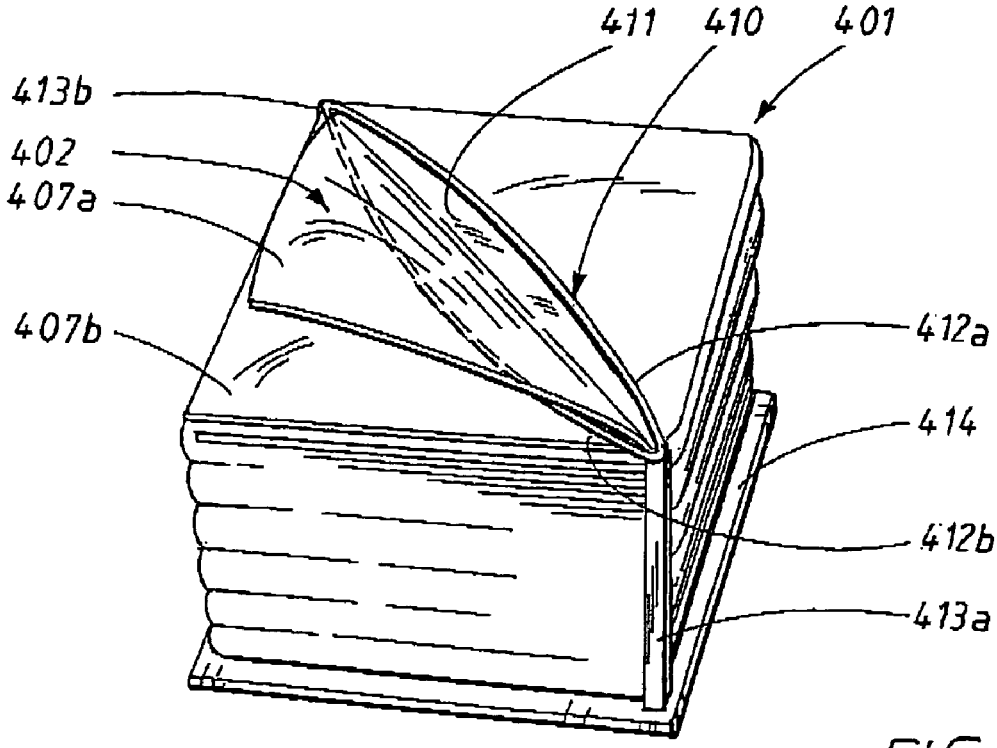
FIG. 4 shows a dispenser containing a stack of material sheets according to the invention.

An alternative form of the dispenser 310 shown in FIG. 3 is illustrated in FIG. 4. Here, the stack 401 of material sheets 402 is arranged in a dispenser 410 consisting of two obstacles 412*a, b* lying on the stack 402 which are joined by two diagonally oppositely positioned side arrangements 413*a, b* and also a bottom plate 414. Here, the two obstacles 412*a, b* are designed with a concave shape but can of course be designed in another way suitable for the purpose. One advantage of this type of dispenser is that the material sheet is allowed greater freedom of movement to be unfolded during extraction of the material sheet through the dispensing opening 411 as no surfaces hold down the remaining part of the first panel 407*a* and the second panel 407*b*. In addition, such a dispenser fashioned from a material of high density such as, for example, a suitable metal, can also act better as a resistance to the force which acts on the obstacle when the material sheet is extracted from the dispenser.

In the dispenser 410, the stack 401 of material sheets 402 advantageously has a longitudinal folding line 403 which is displaced in relation to the longitudinal centre line as described in connection with FIG. 1. A displacement of the folding line then means, as mentioned above, a displacement of the folded material sheet with regard to itself, which in turn facilitates taking hold of the first material sheet in the ready-folded stack.

A dispenser as above can be provided with the stack of material sheets as it is. Alternatively, the stack of material sheets can be enclosed by some form of cover which can provide protection during storage and handling of the stack. The cover can then be retained around the stack when the latter is placed inside a dispenser as above.

FIGS. 5A–5D illustrate a method by which a stack of material sheets is produced according to one embodiment of the invention.

Figures 5A, 5B, 5C:
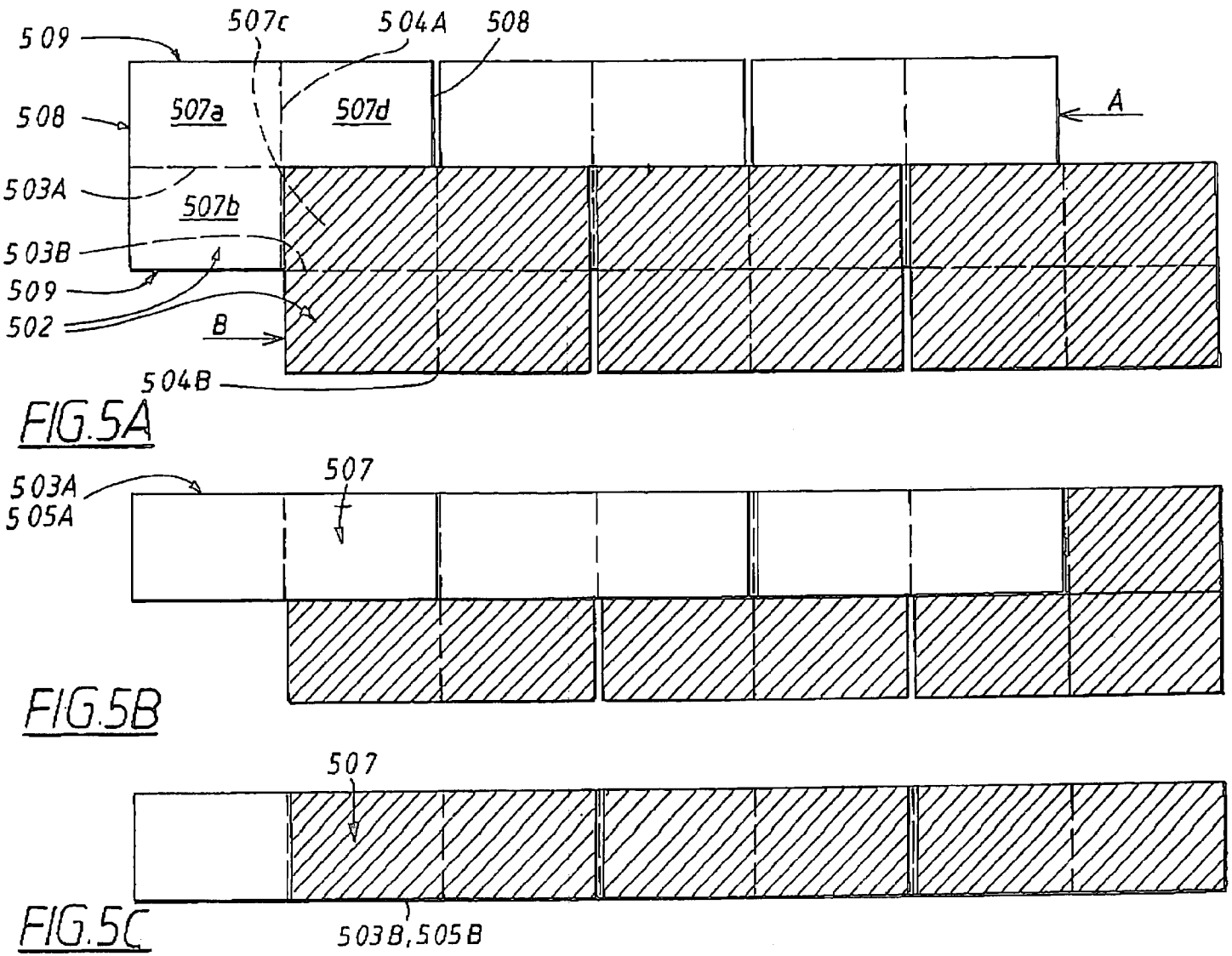
FIG. 5A shows a plan view of two webs of material sheets which have been applied one to another according to a method for production of the invention.
FIG. 5B shows a plan view in which one of the two webs of material sheets has been folded around the other web of material sheets according to a method for production of the invention.
FIG. 5C shows a plan view in which the second of the two webs of material sheets has been folded around the first web of material sheets according to a method for production of the invention.
Figure 5D:
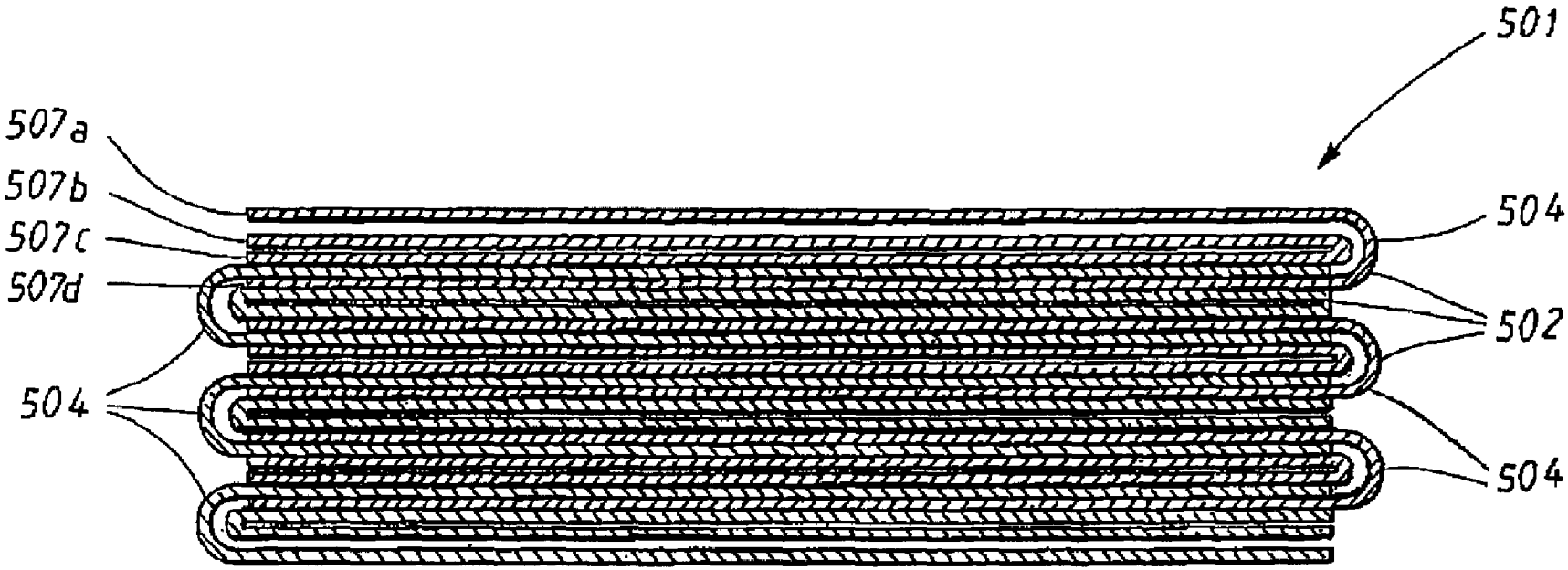
FIG. 5D shows a cross-sectional view of a stack of material sheets according to one embodiment of the invention.
Figures 6A, 6B, 6C:
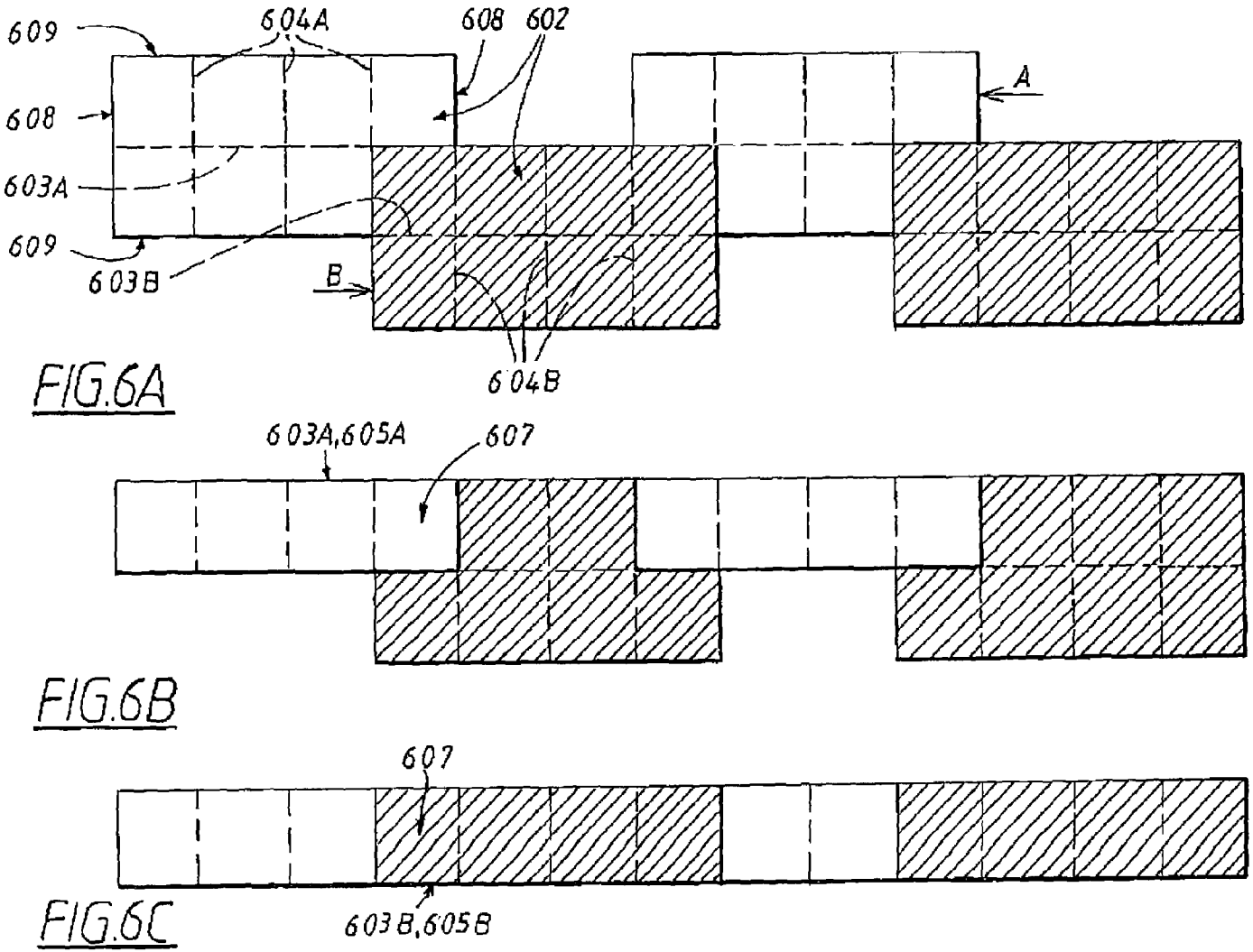
FIG. 6A shows a plan view of two webs of material sheets which have been applied one to another and separated from one another according to a method for production of the invention.
FIG. 6B shows a plan view in which one of the two webs of material sheets has been folded around the other web of material sheets according to a method for production of the invention.
FIG. 6C shows a plan view in which the second of the two webs of material sheets has been folded around the first web of material sheets according to a method for production of the invention.
Figure 6D:
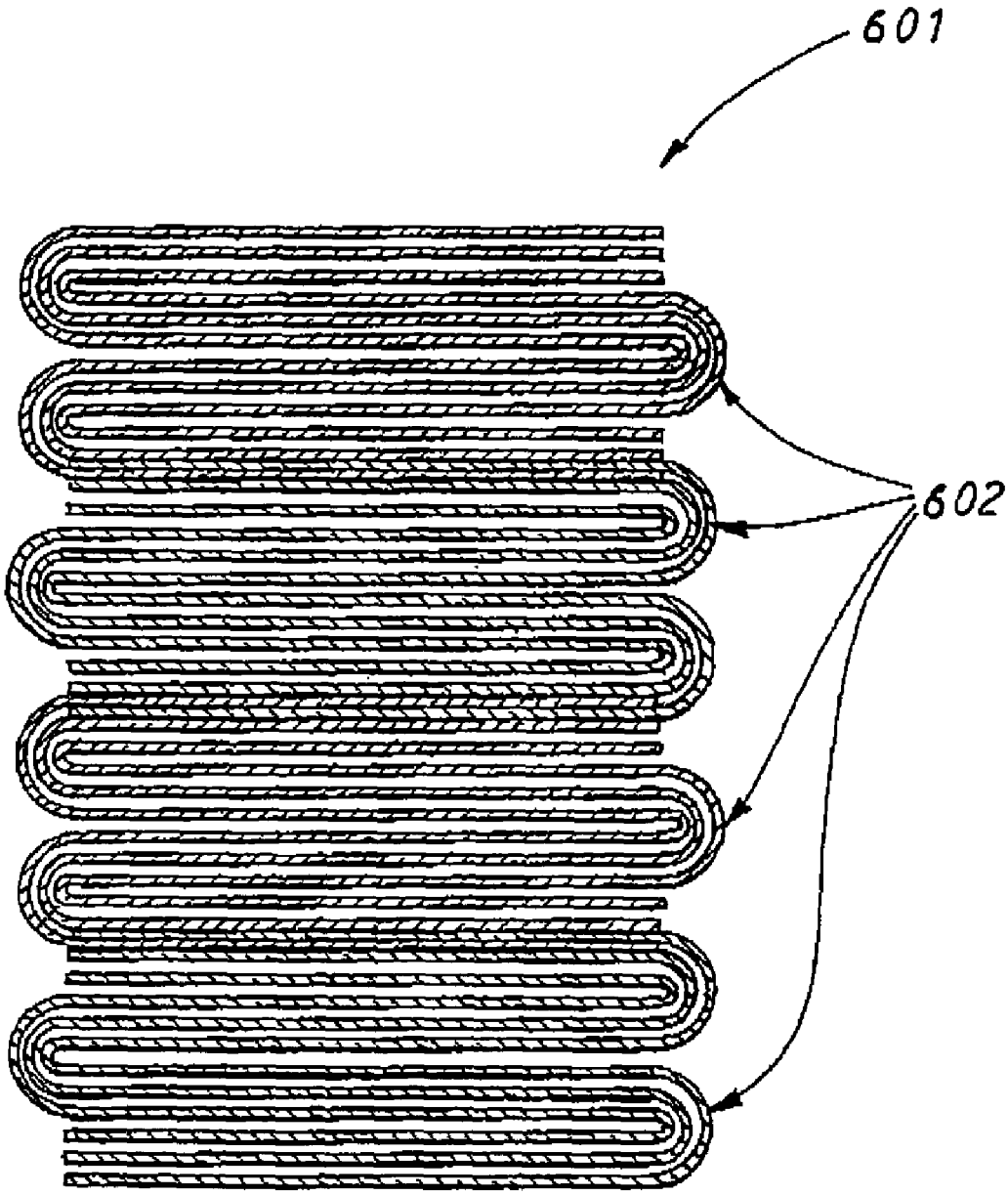
FIG. 6D shows a cross-sectional view of a stack of material sheets according to another embodiment of the invention.

FIG. 5A shows a plan view of two webs A, B of material sheets 502 which have been applied one to another. The material sheets 502 lie arranged individually one after another and form respective longitudinal material webs A, B. In its unfolded state, each individual material sheet 502 has two transverse side edges 508 and two longitudinal side edges 509. The material sheets 502 may have been separated from one another at an earlier stage or have been separated from a continuous material piece which was already arranged in the form of a material web. The web lying on the bottom, web A, has a longitudinal folding line 503A and a transverse folding line 504A. The transverse folding lines 504A consist of folding lines located centrally in the individual material sheets 502. The respective folding lines 504A and the transverse side edges 508 delimit the material sheet 502 so that four rectangles 507*a, b, c, d* are formed. In a ready-folded state, these rectangles form the panels 507*a, b, c, d* of the material sheet, which are represented in FIG. 5D. The web lying on top, web B, has a corresponding longitudinal folding line 503B, a transverse folding line 504B and panels 507*a, b, c, d*.

The material sheets 502 in the respective webs are in this way interlinking by means of a longitudinal part of the first web and a longitudinal part of the second web. In other words, the first material sheet in the first web overlaps the first material sheet in the second web with an interlinking panel 507 of the respective material sheets. Here, the panel 507 is in the form of a rectangle with two longer longitudinal sides and two shorter transverse sides. The rectangle can also advantageously consist of a square.

The subsequent folding step of web A is shown in plan view in FIG. 5B. The material web A is now illustrated folded around its longitudinal folding line 503A and with that forms a longitudinal fold edge 505A. The material web A therefore encloses a longitudinal part of the material web B with the longitudinal parts formed by the fold edge 505. In this context, the terms longitudinal folding line and longitudinal fold edge mean the folding line/fold edge which extends along the entire extent of the material web in contrast to the folding line/fold edge of the individual material sheet which is limited by the extent of the material sheet.

FIG. 5C shows in plan view how the material web B has been folded around its longitudinal folding line 503B in order to form the longitudinal fold edge 505B. The material web B now encloses, with the longitudinal part formed by the fold edge 505B, a corresponding longitudinal part of the material web A. The two material webs now lie alternately in plies arranged around one another with their respective folded parts.

Finally, FIG. 5D shows a cross-sectional view of a stack 501 of material sheets 502 after the structure folded in the longitudinal direction has been folded together around all the transverse folding lines 504 of the material web. This type of transverse folding results in a stack of material sheets with excellent folding-out characteristics when extraction takes place as described above.

FIGS. 6A–6D illustrate a method by which a stack of material sheets is produced according to another embodiment of the invention.

Like the method represented in FIGS. 5A–5D, FIGS. 6A–6D show how two webs of material sheets 602 have been applied one to another and folded around one another in order to form a stack 601 of material sheets 602 according to another embodiment. In contrast to FIGS. 5A–5D, FIGS. 6A–6D show the two material webs A, B with the material sheets separated from one another in the respective webs A, B by a mutual spacing. The material sheets 602 in the two webs can be separated in an earlier step before they are applied one to another, or they can be separated after application. The increased mutual spacing between the material sheets 602 in the respective webs allows space for further transverse folding lines 604A, B within the longitudinal extent of the material sheet. In this case, the material sheet has three transverse folding lines within the extent of the material sheet. Folding around the respective longitudinal folding lines 603A, B and transverse folding lines 604A, B illustrated here of the material webs gives rise to material sheets with eight rectangles, or panels, in the interfolded state. The interlinking between the two webs takes place in the same way as described in FIGS. 5A–5D, that is to say by means of interfolding the respective material webs around an interlinking rectangle 607. In this embodiment, the four centrally located rectangles have no interlinking function but are intended only for providing material sheets 602 with increased surface area of the material sheet.

Another difference in relation to the stack of material sheets described above is that the material webs represented in FIGS. 6A–6D have been provided with further longitudinal folding lines along the side edges 609. Further longitudinal parts are folded in along the respective side edges of both the material webs A, B. The parts are not unfolded automatically when extraction of individual material sheets from the ready-folded stack takes place but have to be freed in a separate unfolding step, such as shaking the material sheet. This type of folded-in part is advantageous when increased surface area is required, or alternatively when material sheets with increased wiping capacity in parts of a material sheet are required, that is to say in cases where the user chooses not to unfold the material sheet fully. The folded-in longitudinal part of the respective material sheets is represented more clearly in the cross-sectional view in FIG. 6D.

The invention claimed is:

1. A stack of material sheets comprising;

material sheets having a longitudinal direction and a transverse direction;

each of said material sheets being folded at least once in said transverse direction along a transverse folding line and at least once in said longitudinal direction along a longitudinal folding line;

each of said material sheets comprising rectangular panels having a single material sheet thickness and having two delimiting edges formed from said at least one longitudinal fold line and said at least one transverse fold line;

consecutive material sheets in said stack being folded into one another and interlinked by said panels;

said panels arranged such that a single panel of a first material sheet is enclosed by two panels of a next second material sheet and a longitudinal fold edge of said first material sheet is arranged opposite a corresponding longitudinal fold edge of said next second material sheet; and said panels providing sufficient interlinking between consecutive material sheets such that when a first material sheet is extracted, a predetermined part of a next second material sheet is fed out.

2. The stack of material sheets according to claim 1, wherein said interlinking panel constitutes a quarter of the total area of the unfolded material sheet.

3. The stack of material sheets according to claim 1, wherein said interlinking panel constitutes an eighth of the total area of the unfolded material sheet.

4. The stack of material sheets according to claim 1, wherein said interlinking panel is a square.

5. The stack of material sheets according to claim 1, wherein at least one longitudinal folding line is somewhat displaced in relation to the longitudinal centre line in at least one of the two consecutive material sheets.

6. The stack of material sheets according to claim 1, wherein at least one transverse folding line is somewhat displaced in relation to a corresponding transverse centre line in at least one of the two consecutive material sheets.

7. The stack of material sheets according to claim 1, wherein said material sheet is a tissue sheet, or a material sheet consisting of non-woven or of equivalent flexible wiping material.

8. The stack of material sheets according to claim 1, wherein said material sheet has a surface area in an unfolded state of between 100 $cm^2$–1500 $cm^2$, and corresponding surface areas in an interfolded state of between 25 $cm^2$–375 $cm^2$.

9. The stack of material sheets according to claim 8, wherein said material sheet has a surface area in an unfolded state of between 256 $cm^2$–576 $cm^2$, and corresponding surface areas in an interfolded state of between 64 $cm^2$–144 $cm^2$.

10. The stack of material sheets according to claim 1, wherein said material sheet has a surface area in an unfolded state of between 200 $cm^2$–2500 $cm^2$, and corresponding surface areas in an interfolded state of between 25 $cm^2$–375 $cm^2$.

11. The stack of material sheets according to claim 10, wherein said material sheet has a surface area in an unfolded state of between 512 $cm^2$–1152 $cm^2$, and corresponding surface areas in an interfolded state of between 64 $cm^2$–144 $cm^2$.

12. The stack of material sheets according to claim 1, wherein said stack of material sheets is arranged in a dispenser.

13. The stack of material sheets according to claim 12, wherein the uppermost material sheet of said stack is arranged so that it protrudes through a dispensing opening arranged in the dispenser with a triangular part area of the rectangular panel.

14. The stack of material sheets according to claim 1, wherein said stack of material sheets is arranged in a dispenser designed as a box.

15. The stack of material sheets according to claim 1, wherein said stack of material sheets is arranged in a dispenser having two obstacles lying on the stack; said obstacles being joined by two oppositely positioned side arrangements and a bottom plate.

16. The stack of material sheets according to claim 14, wherein said stack of material sheets is arranged in a dispenser made of cardboard.

17. The stack of material sheets according to claim 15, wherein said stack of material sheets is arranged in a dispenser made of metal.

18. The stack of material sheets according to claim 15, wherein said stack of material sheets is arranged in a dispenser having a bottom plate which is coated with an attachment means.

19. A method of producing a stack of material sheets, which comprises the following sequential steps:

(a) applying a first web of adjacent individual material sheets to a second web of adjacent individual material sheets so that a longitudinal part of said first web overlaps a longitudinal part of said second web and so that a first material sheet in said first web overlaps a first material sheet in said second web with a panel of the respective material sheets; said panel comprising a rectangle delimited by a longitudinal folding line and a transverse folding line;

(b) folding said second web on a first longitudinal folding line so that said second web material sheets of said second web enclose a part of said first web material sheets;

(c) folding said non-enclosed part of said first web around a second longitudinal folding line to enclose a part of said folded second web material sheets of step (b);

(d) folding the folded structure of (c) in the transverse direction on at least one of said transverse folding line in each individual material sheet so that a stack of material sheets is formed.

20. The method according to claim 19, wherein said material sheets in the respective first and second web are separated from one another by a mutual spacing.

21. The method according to claim 20, wherein said material sheets in the respective webs are arranged at a mutual spacing corresponding to half the length of said material sheet.

22. The method according to claim 19, wherein the longitudinal folding line in said material sheets of at least one web is arranged so that it runs along a centre line in said web.

* * * * *